US006793539B1

(12) United States Patent
Lee et al.

(10) Patent No.: US 6,793,539 B1
(45) Date of Patent: Sep. 21, 2004

(54) LINKING APPARATUS FOR STACKABLE NETWORK DEVICES

(75) Inventors: Chih-Chiang Lee, Zhanghua (TW); Yu-Chih Liu, Panchiao (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/419,009

(22) Filed: Apr. 18, 2003

(51) Int. Cl.[7] ..... H01R 13/502

(52) U.S. Cl. ..... 439/701; 439/607; 439/541.5; 439/638; 439/105; 439/119; 385/92

(58) Field of Search ..... 439/701, 607, 439/541.5, 638, 105, 119; 385/92

(56) References Cited

U.S. PATENT DOCUMENTS 6,431,765 B1 * 8/2002 Chen et al. ..... 385/92
6,532,155 B2 * 3/2003 Green et al. ..... 361/733
6,576,833 B2 * 6/2003 Covaro et al. ..... 174/35 GC
6,600,865 B2 * 7/2003 Hwang ..... 385/134
6,607,307 B2 * 8/2003 Gilliland et al. ..... 385/88
6,623,297 B2 * 9/2003 Hwang ..... 439/541.5
6,648,693 B1 * 11/2003 Hogan et al. ..... 439/630
6,652,161 B2 * 11/2003 Grann et al. ..... 385/93

OTHER PUBLICATIONS

"GigaStack GBIC" Cisco Systems, Inc.; 2000.

* cited by examiner

*Primary Examiner*—Truc T. T. Nguyen
(74) *Attorney, Agent, or Firm*—Thomas, Kayden, Horstemeyer & Risley

(57) ABSTRACT

A linking apparatus is provided for establishing interconnection for stackable network switch. The linking apparatus includes an electronic circuit configured for providing stacking interconnection between two stackable network devices. A miniature GBIC-compliant (Gigabit Interface Connector) connector locates at an end of the electronic circuit. And two USB (Universal Serial Bus) connectors are arranged as a stacking module at the other end of the electronic circuit for providing uplink and downlink connections.

13 Claims, 3 Drawing Sheets

LINKING APPARATUS FOR STACKABLE NETWORK DEVICES

BACKGROUND OF THE INVENTION

A. Field of the Invention

The invention relates in general to an apparatus for providing interconnectivity to a stack of network devices, and particularly to a small form-factor pluggable linking apparatus for use in stackable network switches.

B. Description of the Related Art

It is known in the art that Ethernet bandwidth can be expanded via the stacking of switches. Switches in a stack configuration are connected in a cascade utilizing stacking modules. For expansion, a conventional stackable switch provides an open slot for installation of stacking modules, which is equipped with a stacking port and a GBIC (Gigabit Interface Converter) port. While the stacking port is for switch stacking, the GBIC port provides for flexible deployment of multimode or extended cable-length single mode fiber.

As the Ethernet speed increases to a gigabit per second, 100BaseT GBIC has been widely adopted for fiber environments. A stackable switch is usually packed with 100BaseFX multimode fiber ports and GBIC-based Gigabit Ethernet ports in a rack unit stackable form factor. Since the speed is increased 10 times, the speed of port for interconnection also needs to be increased comparably to reduce port latency.

GBIC, currently at revision 5.5 by the Small Form Factor (SFF) Committee, has evolved from copper to optical fiber transmission (Module Definition "7") and become widely used. One of its popular applications is for stacking expansion of switches in gigabit Ethernet systems. For example, GigaStack® GBIC shown in FIG. 1, manufactured by Cisco systems, Inc. of San Jose, Calif., is one linking apparatus used for stacking gigabit Ethernet switches. However, it takes up considerable panel surface area in comparison to miniature GBIC standard. This is due to its relatively large slot opening that limits the number and placement arrangement of networking slots on the back plane of a switch device.

SUMMARY OF THE INVENTION

The present invention provides an improved compact linking apparatus for use in network devices to increase system port density. The one-piece linking apparatus of the invention provides a simple, efficient, and very cost-effective compact linking apparatus for coupling USB (Universal Serial Bus) cables in stacking switches.

Moreover, the linking apparatus of the invention attains the flexibility and simplicity of the USB connector in connector design and ease of use. Also, the linking apparatus is hot-swappable and compliant with miniature GBIC standard for plugging into a miniature GBIC port of a stackable switch.

The present invention achieves the above and other objects by providing a linking apparatus for use in a cascade stack of stackable network devices. The invention includes an electronic circuit configured for providing stacking interconnection among the network devices. A miniature GBIC-compliant connector is at an end of the electronic circuit. Two USB (Universal Serial Bus) connectors arranged as a stacking module is at the other end of the electronic circuit.

BRIEF DESCRIPTION OF THE DRAWINGS

These and other objects and advantages of the present invention will become apparent when considered in view of the following description and accompanying drawings wherein.

DETAILED DESCRIPTION OF THE PREFERRED EMBODIMENT

Figure 1:
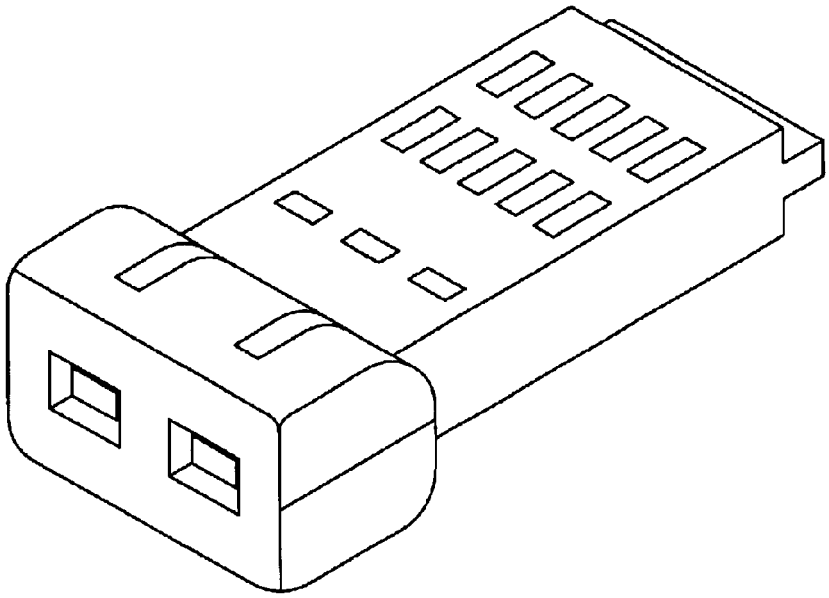
FIG. 1 (PRIOR ART)
FIG. 1 is a perspective view illustrating the physical outline of the GigaStack™ of Cisco Systems, Inc.
Figure 2:
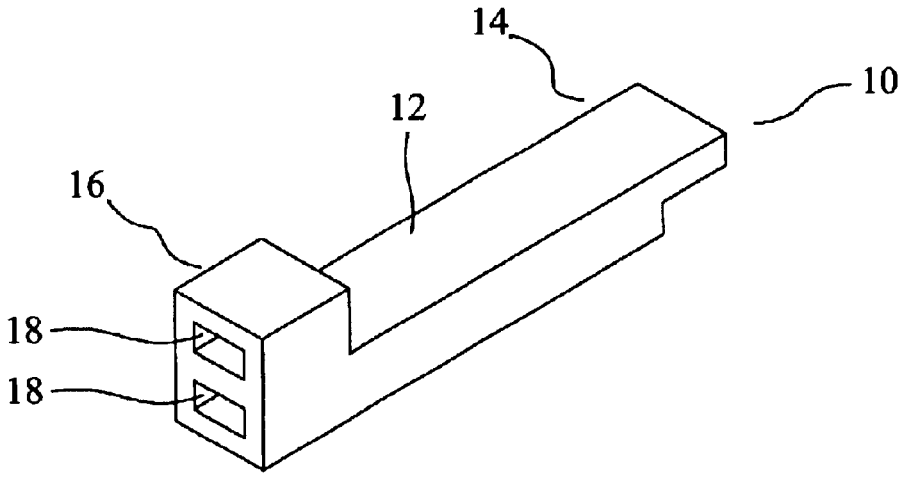
FIG. 2 is a perspective view illustrating an embodiment of the physical outline of a small form-factor pluggable linking apparatus of the present invention.

The perspective view of FIG. 2 shows an embodiment of the physical outline of a small form-factor pluggable linking apparatus of the present invention. The linking apparatus 10 is a standalone connector that includes a housing 12 for enclosing an electronic circuit (not shown in FIG. 2), and electrical connectors. One miniature GBIC-compliant connector 14 for implementing electronic connection to a host network communication device (such as a switch) is made at an end of the linking apparatus 10. Two USB connectors arranged as a stacking module 16 for linking connection between devices is at the other end of the linking apparatus 10.

In the depicted embodiment, the slots 18 are mechanically compliant with the USB specification and arranged as a stacking module. This arrangement helps to reduce the width of the linking apparatus 10 and increase the system port density. The housing 12 may include a metal cage for suppressing electromagnetic interference. Various EMI cages are applicable. A preferred EMI cage is usually conveniently designed to be a one-piece construction and with press-fit pins to be securely mounted to the printed circuit board of the linking apparatus 10 without the need for soldering. The miniature GBIC-compliant connector 14 located at an end of the linking apparatus 10 is compliant with the miniature GBIC specification in shape for easily plugging into the standard miniature GBIC slot of stackable network devices, such as a network switch.

Preferably, the miniature GBIC-compliant connector 14 at the end of the linking apparatus 10 is compliant with the miniature GBIC slot of the SFP specification. The electrical connector can be conveniently made at the edge of the printed circuit board of the linking apparatus 10 and mechanically compliant with the standard SFP edge connector. The pin assignment in this edge connector allows itself to be mated with the SFP electrical connector. According to the specification, the contact pads in the edge connector are designed for a sequenced mating. The design of the mating portion of the printed circuit board of the linking apparatus 10 thus supports hot-swapping of the linking apparatus 10 into and out of a network switch.

On the other hand, the USB connectors arranged as a stacking module at the other end of the linking apparatus 10 includes at least two USB-like slots 18. Note these are female slots mechanically compatible to the USB standard for USB jacks to plug in. As will be described subsequently, these slots 18 are mechanically compatible to USB but functionally different.

Thus, the linking apparatus 10 as illustrated in FIG. 2 is a generally elongated apparatus for plugging into the mini-GBIC slot of a network communication device, such as a network switch. The connector 14 at its rear end can be hot-swappable and conveniently inserted into the SFP slot of the network device. The two USB-like slots 18 arranged as a stacking module 16 form a protrusion portion of the linking apparatus 10 after plugging into the SFP slot.

Figure 3:
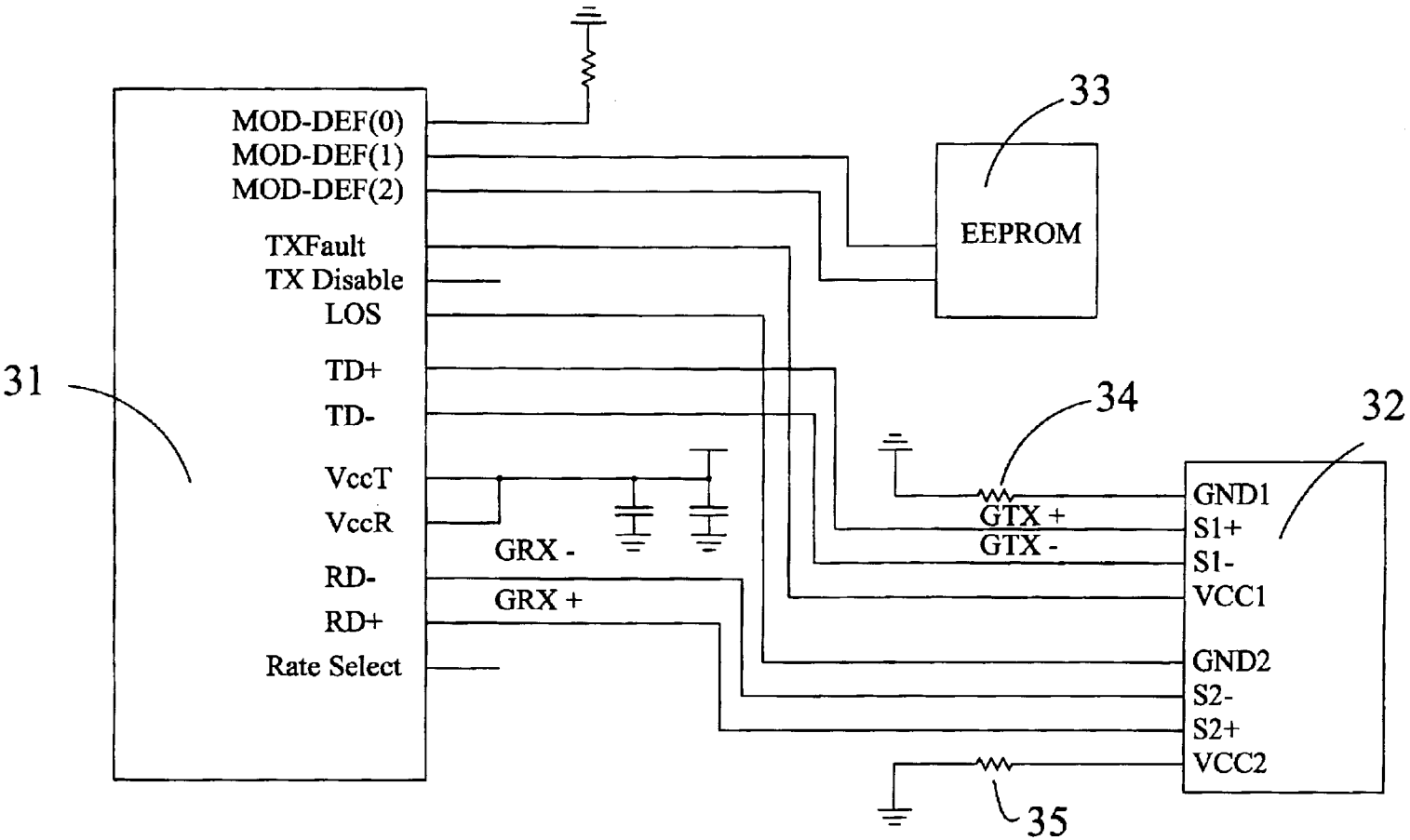
FIG. 3 is a schematic diagram illustrating the electronic circuitry for a preferred embodiment of the linking apparatus of the present invention.

FIG. 3 is a schematic diagram depicting the electronic circuitry of a preferred embodiment of the linking apparatus of the present invention. The circuit diagram illustrates the basic circuit configuration of an embodiment suitable for implementation on the printed circuit board of the linking apparatus. The exemplified circuitry includes a miniature GBIC-compatible SFP connector 31 and a USB-like linkage connector 32. A memory device, shown as EEPROM 33 in the drawing, can be included in the circuitry in a preferred implementation for identification purposes of the linking apparatus.

In the schematic diagram of FIG. 3, the SFP connector 31 is provided to allow for the plug-in insertion of the inventive linking apparatus 10 into an SFP-compliant slot. Preferably, the inventive linking apparatus 10 is made to be mechanically compatible to the standard SFP slot found in network switch with mini-GBIC slots. To achieve this compatibility, the SFP connector 31 is implemented as the standard edge connector with gold-plated contact pads specified by SFF-MSA. Without such mechanical compatibility to the SFP connector, however, a linking apparatus can only be a proprietary device, although electrical compatibility can be implemented.

On the other hand, the USB-like linkage connector 32 includes a pair of slots that S are mechanically compatible to a USB slot but not electrically, or, functionally. The pair of two USB-like connector slots is grossly represented in the circuit diagram as linkage connector 32 is provided for interconnections between, for example, cascaded switches in a stacking. The two USB-like slots of the linkage connector 32 can be found in the drawing as the two groups of four power/signal pins.

To ensure the proper use of USB cables for a linking apparatus of the present invention in an application such as switch stacking, the signal paths in the USB-like slots of the linkage connector 32 are used in a manner similar to the use in an original USB slot. Preferably, an original ground pin (GND1) of the USB slot is assigned as a ground pin for the interconnections between the network switch.

The other signal pins of each USB-like slot in linkage connector 32 are assigned for the input and output signaling of the linking apparatus. Specifically, when employed for switch stacking applications, the circuit arrangement of the depicted embodiment of FIG. 3 may assign VCC1, GND1, S1+ and S1− of the first USB-like slot of connector 32 as the input port and VCC2, GND2, S2+ and S2− of the second USB-like slot as the output port. The USB-like slot of connector 32 is thus full-duplex with a maxim transmission speed of near gigabit per second. Utilizing a standard USB cable in such a stacking, the entire group of power/signal lines (VCC1, GND1, S1+ and S1−) of the output port of a first linking apparatus plugged into the SFP slot of a first switch would be electrically connected to the corresponding group of power/signal lines (VCC2, GND2, S2+ and S2−) of the input port of a second linking apparatus plugged into a second switch.

In the stacking of switches, the differential output signal pair GTX+ and GTX− of a typical switch device used for uplink needs to be tied to the differential input signal pair GRX+ and GRX− of another interconnected switch. This can be achieved by the connection arrangement of FIG. 3. Specifically, as the first linking apparatus of the present invention is plugged into the SFP slot of the first switch, its SFP connector 31 ties its TD+ and TD− signal pair pursuant to the SFP Specification to the differential signal pair GTX+ and GTX− of the first switch. On the other hand, the plug-in of a second of the inventive linking apparatus 10 into the SFP slot of the second switch ties its RD+ and RD− signal pair to the differential signal pair GRX+ and GRX− of the second switch. A cabling between the USB-like input port of the linkage connector 32 of the first linking apparatus and the USB-like output port of the linkage connector 32 of the second linking apparatus establishes this GTX/GRX connection between two cascaded switches.

The cabling used for such switch stacking application can be any standard USB cable, preferably one compliant to USB 2.0 Specification. Since stacked switches are normally installed in close physical proximity, the length of the USB cable is preferably minimized to ensure maximum possible data throughput.

In the depicted embodiment of FIG. 3, the ground pin (GND1) of the input port group of interconnection signals at the corresponding USB-like slot of the linkage connector 32 is coupled to ground via a resistor 34. Similarly, the power pin (VCC2) of the output port group of signals of the other USB-like slot of the connector 32 is also coupled to system ground via another resistor 35. This arrangement provides for the networking devices linked via the use of the linking apparatus 10 to check if a linking apparatus is present via connection at the input and output ports. Specifically, the LOS signal detected by the linked device at the corresponding pin of the SFP connector 31 can be used for checking the presence of the linking apparatus 10 in response to its electrical potential. On the other hand, the TX Fault signal at the corresponding pin of SFP connector 31 can be used to check the presence of the linking apparatus 10 at the output port.

Note in the schematic diagram of FIG. 3 that a memory device 33, a commercial EPROM or EEPROM such as 24C02 is also provided for the storage of on-site information regarding the specifics of the interconnected devices as well as the identification of the linking apparatus itself.

Figure 4:
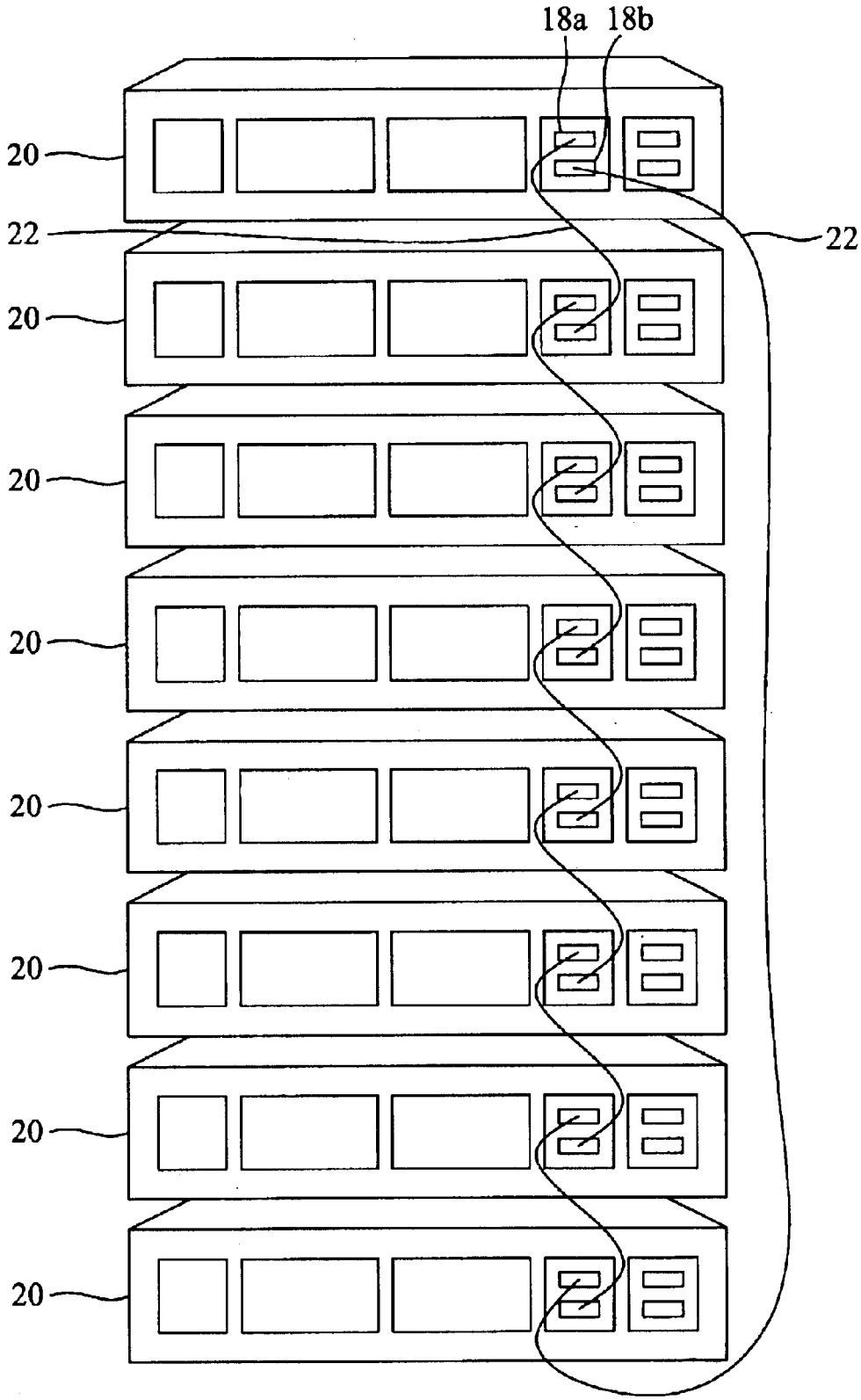
FIG. 4 schematically illustrates an embodiment of the stacking of a number of switches utilizing the linking apparatus of the present invention via interconnections provided by USB cables.

FIG. 4 schematically illustrates an embodiment of the stacking of a number of switches utilizing the linking apparatus of the present invention via interconnections provided by standard USB cables. A total of eight switches 20 are installed in close proximity and stacked into one single Ethernet switch system. In each individual switch 20, a linking apparatus 10 in accordance with the teaching of the present invention is provided for the implementation of stacking of the switches. At each linking apparatus 10, a pair of two ports, one output port 18*a* and one input port 18*b* are provided in the form of USB-like slots. For stacking interconnections, the output port 18*a* of the linking apparatus 10 in a switch 20 is connected via a USB cable 22 to the input port 18*b* of the linking apparatus in a next switch, as is illustrated in the drawing. In the exemplified cascade stacking of switches, the last switch in the stack is further looped back to the first switch, as is illustrated by the long USB cabling 22, establishing a redundant link in the stacking.

The linking apparatus 10 for each switch 20 in the switch stacking of FIG. 4 can either be built integrally to its host switch or be constructed as Modular One-compliant to the SFP Specification mechanically. In the latter case, one such pluggable linking apparatus 10 can be used to implement switch stacking, although short of the full functionality of a GBIC transceiver due to the omission of certain of the necessary control signals (TX Disable and Rate Select pins specifically). However, in addition to reduced transceiver costs, such a stacking of network switches enjoys the huge benefit of reduced cabling costs due to the simplicity of electrical design. Also, USB cables are easily available, making stacking of switches for network expansion extremely easy and convenient.

While the above is a full description of the specific embodiments, various modifications, alternative constructions and equivalents may be used. For example, although network switches have been used as example for the description of the present invention, other network devices such as hubs and routers requiring stacking expansions can also be applicable. Therefore, the above description and illustrations should not be taken as limiting the scope of the present invention which is defined by the appended claims.

What is claimed is:

1. A linking apparatus for use in a cascade stack of stackable network devices, said link apparatus comprising:

an electronic circuit configured for providing stacking interconnection among said network devices;

a miniature GBIC-compliant (Gigabit Interface Connector) connector installed at one end of said electronic circuit;

first USB (Universal Serial Bus) connector installed at the other end of said electronic circuit, and the width of said first USB connector is essentially the same as the width of said miniature GBIC-compliant connector; and a second USB connector stacked on the top of said first USB connector, wherein said second USB connector is electrically connected to said electronic circuit, and the width of said second USB connector is essentially the same as the width of said miniature GBIC-compliant connector.

2. The linking apparatus of claim 1, further comprising a housing for enclosing said electronic circuit, said miniature GBIC-compliant connector and said two USB connectors.

3. The linking apparatus of claim 2, wherein said housing comprises a metal cage for reducing electromagnetic interference.

4. The linking apparatus of claim 1, wherein said two USB connectors are for uplink and downlink connections.

5. A system having a plurality of stackable network devices, wherein one or more of said stackable network devices are interconnected via a miniature GBIC (Gigabit Interface Connector) port, said system comprising:

an electronic circuit, configured for providing stacking interconnection;

a miniature GBIC-compliant connector (Gigabit Interface Connector) installed at a one end of said electronic circuit for plugging into said miniature GBIC port of said one or more stackable network devices;

first USB (Universal Serial Bus) connector installed at the other end of said electronic circuit for providing uplink and downlink connections, and the width of said first USB connector is essentially the same as the width of said miniature GBIC-compliant connector; and a second USB connector stacked on the top of said first USB connector, wherein said second USB connector is electrically connected to said electronic circuit, and the width of said second USB connector is essentially the same as the width of said miniature GBIC-compliant connector.

6. The system as claimed in claim 5, further comprising a housing for enclosing said electronic circuit, said miniature GBIC-compliant connector and said two USB connectors.

7. The system as claimed in claim 6, wherein said housing comprises a metal cage for reducing electromagnetic interference.

8. The system as claimed in claim 5, wherein said two USB connectors are for uplink and downlink connections.

9. The linking apparatus of claim 1, wherein said miniature GBIC-compliant connector is grounded via a resistor.

10. The linking apparatus of claim 1, wherein said first USB connector and said second USB connector are grounded via at least one resistor.

11. The system as claimed in claim 5, wherein said miniature GBIC-compliant connector is grounded via a resistor.

12. The system as claimed in claim 5, wherein said first USB connector and said second USB connector are grounded via at least one resistor.

13. A linking apparatus for use in a cascade stack of stackable network devices, said link apparatus comprising:

an electronic circuit configured for providing stacking interconnection among said network devices;

a miniature GBIC-compliant connector installed at one end of said electronic circuit, wherein said miniature GBIC-compliant connector is grounded via a first resistor;

a first USB connector installed at the other end of said electronic circuit, and the width of said first USB connector is essentially the same as the width of said miniature GBIC-compliant connector, and said first USB connector is grounded via at least one second resistor; and a second USB connector, stacked on the top of said first USB connector, wherein said second USB connector is electrically connected to said electronic circuit, and the width of said second USB connector is essentially the same as the width of said miniature GBIC-compliant connector, and said USB connector is grounded via at least one third resistor.

* * * * *